US009656780B1

(12) United States Patent
Crawford

(10) Patent No.: US 9,656,780 B1
(45) Date of Patent: May 23, 2017

(54) CONTAINER SEAL WITH DUAL TABS

(71) Applicant: COLGATE-PALMOLIVE COMPANY, New York, NY (US)

(72) Inventor: John C. Crawford, Mahopac, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 15/068,829

(22) Filed: Mar. 14, 2016

(51) Int. Cl.
*B65D 17/00* (2006.01)

(52) U.S. Cl.
CPC ..... *B65D 17/165* (2013.01); *B65D 2517/008* (2013.01); *B65D 2517/0013* (2013.01)

(58) Field of Classification Search
CPC .... B65D 17/24; B65D 17/165; B65D 17/163; B65D 17/161; B65D 17/16; B65D 51/18; B65D 51/20; B65D 77/2024; B65D 41/3428; B65D 1/0238; B21D 51/386; B21D 51/383; B21D 51/443
USPC ..... 220/254.2, 257.2, 257.1, 256.1, 359.3, 220/359.2, 359.1, 270, 266, 265, 212; 215/230, 232, 254, 253, 250, 228; 413/14, 12, 8; 40/311; 206/484.2, 494; D9/438, 435, 416, 518
See application file for complete search history.

(56) References Cited

U.S. PATENT DOCUMENTS

| | | | | |
|---|---|---|---|---|
| 4,637,519 | A | 1/1987 | Dutt et al. | |
| 5,197,618 | A | 3/1993 | Goth | |
| 8,746,484 | B2 | 6/2014 | Thorstensen-Woll | |
| 2016/0114942 | A1* | 4/2016 | Mussio | B65D 43/0222 222/144.5 |
| 2016/0137376 | A1* | 5/2016 | Deflorian | B65D 75/5838 220/270 |

* cited by examiner

*Primary Examiner* — Robert J Hicks

(57) ABSTRACT

A container seal that allows a user to select at least one of two or more different sized openings from which to dispense a liquid product from a container. The container seal includes at least a base layer, and may further include a polymer layer attached to the base layer at one or more locations. The container seal may further include a pull tab. Pulling the pull tab forms an opening within the base layer. Various seal configurations allow one, two, or more different sized openings from which to dispense a liquid product from the container depending, for example, on the user's preferred method of dispensing the liquid product from the container. In one configuration, a pull tab may form one, two, or three or more openings in the container seal.

19 Claims, 7 Drawing Sheets

CONTAINER SEAL WITH DUAL TABS

BACKGROUND

Liquid products such as cleaners, solvents, mouthwash, sports drinks, etc., are commonly supplied to a consumer in a bottle such as a plastic blow-molded bottle or another type of bottle. Access to the product within the bottle requires manipulation of a cap that seals the liquid product within the bottle. Various styles of caps are known. For example, a non-hinged threaded cap may be unscrewed from a threaded mouth of a bottle to completely remove the cap from the bottle to access the product within. A hinged flip cap may include a lower portion threaded onto the bottle and an upper portion attached to the lower portion with a hinge. To use the hinged flip cap, the consumer may articulate the upper cap portion away from the lower cap portion while the lower cap portion having an opening therein remains attached to the bottle, thereby opening the hinged flip cap. The product is dispensed from the opening in the lower cap portion when the hinged flip cap is in the open position.

Some bottles may include a plastic or foil seal between the bottle and the cap that seals the product within the bottle to prevent product contamination or tampering before sale and use by the consumer. Prior to initial use of the product, the consumer may remove the cap from the bottle, peal the seal from a rim around the mouth of the bottle, and then replace the cap.

Non-hinged threaded caps require a user to remove the cap completely from the bottle to access the product within. The mouth of the bottle serves as the orifice from which the product is dispensed. The lower portion of a hinged cap includes an orifice that is smaller than the mouth of the bottle.

Consumers of liquid products supplied in bottles may prefer different methods for dispensing the product from the bottle. To use a liquid cleaner, for example, some consumers may dispense the liquid product from the bottle into a bucket or other receptacle containing an amount of water to dilute the cleaner, while other consumers may prefer to dispense the liquid product directly onto the surface to be cleaned. Similarly, some consumers may dispense mouthwash into a cup prior to use, while others use the product directly from the bottle.

A large opening such as the mouth of the bottle may be sufficient for quickly dispensing a large amount of product from the bottle, for example, into a bucket or cup. However, a large opening may not provide sufficient control when dispensing a smaller amount of product, for example, directly onto a surface or into the mouth, and using a mouthwash product directly from the bottle has sanitation concerns. In contrast, when a consumer prefers to dispense a large volume of product quickly, a small bottle opening that provides sufficient control for dispensing a smaller volume of product may be insufficient for dispensing large volumes quickly.

Hinged flip caps can provide both a small opening in the lower portion of the cap and also a large opening by unscrewing the cap from the bottle and dispensing the product from the mouth of the bottle. However, hinged flip caps and other multi-part caps that are adjustable require complicated molding technology and are expensive relative to the overall cost of product packaging.

For some products, a particular consumer may prefer to have either a small opening for better control or a large opening for increased speed across the entire lifetime of the product. A bottle seal, and a bottle including the seal, that allows a consumer to easily select either a small opening for dispensing a smaller volume of liquid from the bottle with control or for dispensing a larger volume of liquid with speed would therefore be a welcome addition to the art.

BRIEF SUMMARY

A container seal according to the present teachings may include a base layer and a first pull tab configured to facilitate removal of a first portion of the base layer from the container seal to define a first opening within the container seal, wherein the first portion of the base layer has a first surface area. The container seal may further include a second pull tab configured to facilitate removal of a second portion of the base layer, the second portion having a second surface area, wherein the first surface area is smaller than the second surface area.

Optionally, the first surface area and the second surface area together may comprise 100% of a surface area of an entirety of the container seal, or 50% or less of a surface area of the entirety of the container seal.

The container seal may include a polymer layer attached to the base layer. The polymer layer may include the first pull tab and the second pull tab.

Optionally, the container seal may further include a first perforation in the polymer that defines at least a portion of the first pull tab and a second perforation that defines at least a portion of the second pull tab. An adhesive layer may be used to attach the polymer layer and the base layer together.

In an optional aspect, the first pull tab may be configured to facilitate removal of at least two portions of the base layer to define at least two openings in the second portion of the base layer. Further, the first pull tab may include a first indicium that provides an indicator of a configuration of the first opening, and the second pull tab may include a second indicium different from the first indicium that provides an indicator of a configuration of the second opening.

The container seal may include a non-tabbed third portion, wherein the first portion of the container seal and the second portion of the container seal are configured to be separated from the third portion of the container seal.

A container according to the present teachings may include a rim that defines a mouth of the container and a container seal attached to the rim. The container seal may include a base layer and a first pull tab configured to facilitate removal of a first portion of the base layer from the container seal to define a first opening within the container seal, wherein the first portion of the base layer has a first surface area. The container seal may further include a second pull tab configured to facilitate removal of a second portion of the base layer, the second portion having a second surface area, wherein the first surface area is smaller than the second surface area.

Optionally, the first surface area and the second surface area together may comprise 100% of a surface area of the entirety of the container seal, or 50% or less of a surface area of the entirety of the container seal.

The container seal may include a polymer layer attached to the base layer. The polymer layer may include the first pull tab and the second pull tab.

Optionally, the container seal may further include a first perforation in the polymer that defines at least a portion of the first pull tab and a second perforation that defines at least a portion of the second pull tab. An adhesive layer may be used to attach the polymer layer and the base layer together.

In an optional aspect, the first pull tab may be configured to facilitate removal of at least two portions of the base layer to define at least two openings in the second portion of the base layer. Further, the first pull tab may include a first indicium that provides an indicator of a configuration of the first opening, and the second pull tab may include a second indicium different from the first indicium that provides an indicator of a configuration of the second opening.

The container seal may include a non-tabbed third portion, wherein the first portion of the container seal and the second portion of the container seal are configured to be separated from the third portion of the container seal.

The second pull tab may be configured to remove an entirety of the container seal from the rim of the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

It should be noted that some details of the FIGS. have been simplified and are drawn to facilitate understanding of the present teachings rather than to maintain strict structural accuracy, detail, and scale.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The present teachings may include a container seal for a container such as a bottle, for example, a blow-molded plastic bottle or other container, which allows a user to select either a smaller bottle opening for a more controlled dispensing of a liquid or a larger bottle opening for a faster dispensing of the liquid. The container seal may be manufactured at a relatively low cost compared to, for example, a hinged flip cap. Various implementations are described below.

Figure 1:
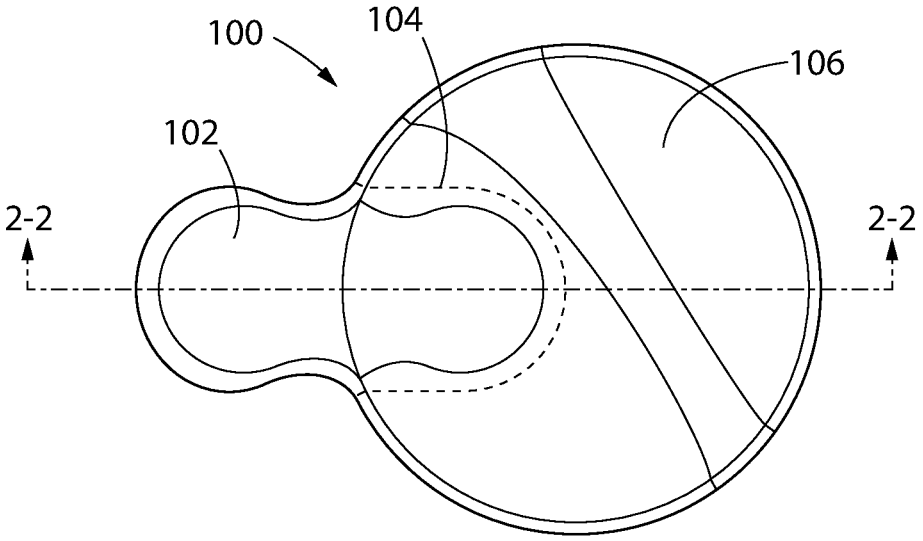
FIG. 1 is a plan view of a container seal according to the present teachings.
Figure 2:
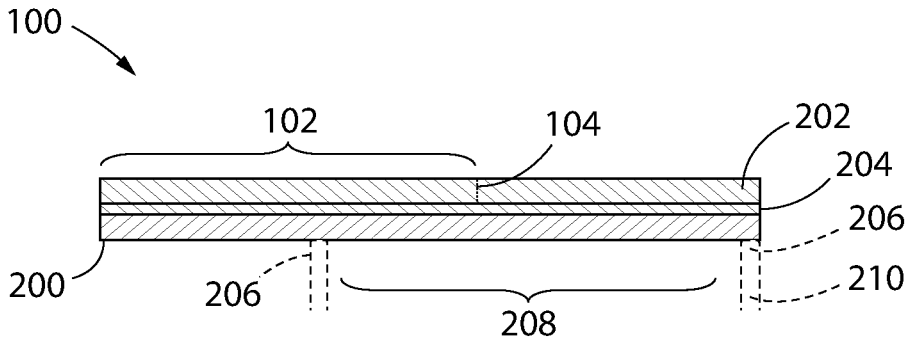
FIG. 2 is a cross section of a container seal according to the present teachings.

FIG. 1 is a plan view, and FIG. 2 is a cross section along 2-2 of the FIG. 1 structure, of a container seal 100 according to the present teachings. The container seal 100 includes a pull tab 102 having a perimeter that is defined in part by a perforation 104 in, on or through at least one seal layer. As used herein, a "tab" or "pull tab" includes a container seal structure intended to more easily facilitate removal of one or more portions of the container seal, including the pull tab. The pull tab may be a flap of container seal material that extends outside a perimeter of a mouth of a container, or that extends vertically or approximately perpendicularly from a main seal portion within the perimeter of the mouth of the container. In various designs, the perforation 104 may be a pierced, almost pierced, embossed, indented, notched, or otherwise weakened line or area along which the container seal 100 will tear or separate or will tend to tear or separate.

The container seal 100 may include one or more layers. As depicted in FIG. 2, the container seal 100 may include a base layer 200, a polymer layer 202, and an optional adhesive layer 204. In one design, the polymer layer 202 may itself adhere sufficiently to the base layer 200 such that a separate adhesive layer 204 is not required. The base layer 200 may be or include, for example, a foil layer such as a metallic foil layer including an aluminum foil layer. The base layer 200 may also be or include a plastic layer or another polymer layer. The base layer 200 may be a food grade material or a non-food grade material, depending on the liquid that will be dispensed from the container. The polymer layer 202 may be or include, for example, a plastic layer or another polymer layer. The adhesive layer 204 may be or include, for example, an ultraviolet (UV)-curable adhesive, a thermoplastic, a thermoset, a pressure-sensitive adhesive, or another suitable adhesive. The container seal 100 may be attached to a rim 206 that forms a mouth 208 of a container 210. The container seal 100 may be an induction sealed container seal that is attached to the rim 206 using, for example, induction sealing. The container seal 100 may be applied using other techniques, for example, radiant heat, friction or ultrasonic heat, or another suitable method.

The container seal 100 may be formed as a sheet of one or more layers of material from which a plurality of container seals 100 are cut or stamped using, for example, a laser cutting process or a stamping process in a press using a die. If the sheet includes two or more layers, the two or more layers may be laminated to form a laminated sheet. The perforation 104 may be formed in the container seal during the stamping or cutting of the seal itself, or during a different stamping, embossing, or cutting process.

Figure 3:
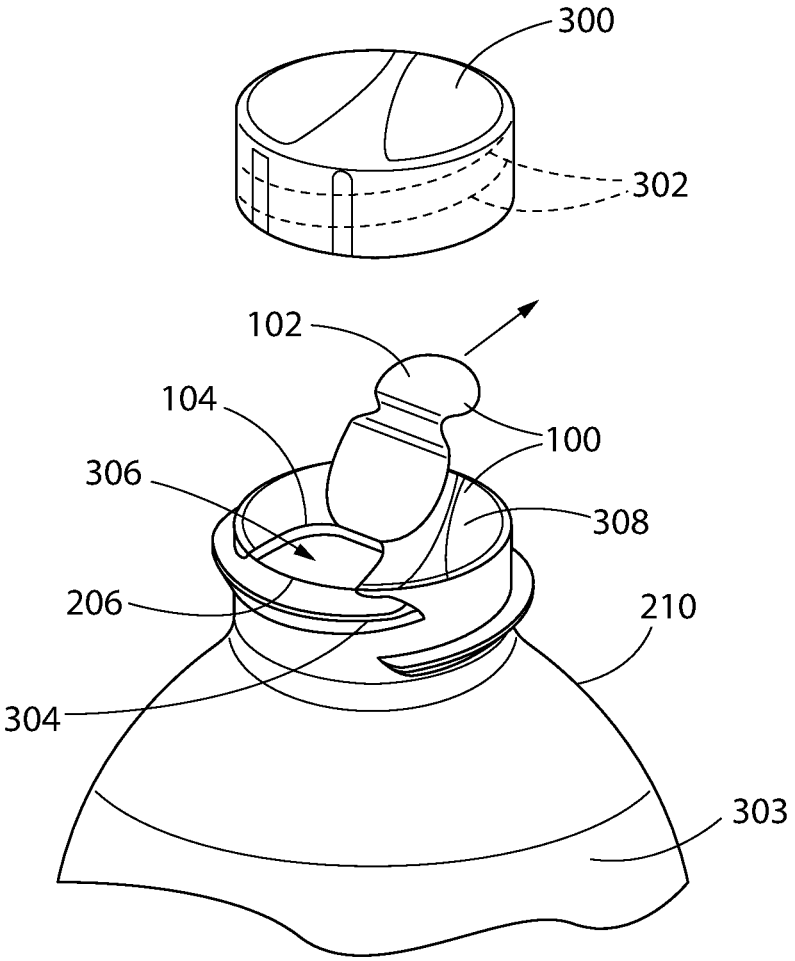
FIG. 3 is a perspective depiction of the container seal of FIGS. 1 and 2 attached to a container during removal of a portion of the container seal using a pull tab.

FIG. 3 is a perspective depiction of a container 210, a liquid product 303 within the container 210, and a container seal 100 attached to the rim 206 of the container 210. FIG. 3 further depicts an optional cap or lid 300 such as a molded threaded cap having threads 302. Other cap or lid designs are contemplated. In some embodiments, no cap may be required, for example, when the contents of the container are supplied for a single use or dose and the entire contents are intended to be dispensed all at once, or in other uses. To manufacture the FIG. 3 structure, the container seal 100 may be placed into the lid 300 and the liquid product 303 may be dispensed into the container 210. The optional cap 300, if used, may then be twisted onto threads 304 of the container 210 with a force sufficient to ensure that base layer 200 physically contacts the rim 206 of the container 210. Subsequently, with the cap 300 attached to the container 210, the cap 300, the container seal 100, and the container 210 may be processed through an induction sealer to adhere the container seal 100 to the rim 206 of the container 210. As known in the art, an induction sealer results in a softening or melting of a thin layer of the container material around the rim 206. Upon removal of the container 210 from the induction sealer, the softened or melted container layer hardens, thereby adhering the container seal 100 to the rim 206 of the container 210.

To open the completed structure or assembly, a user may unscrew the cap 300 to remove the cap 300 from the container 210, while the container seal 100 remains attached to the container 210. The user may then grasp the pull tab 102 and peal the pull tab 102, for example, up and toward the center line of the container 210 as depicted in FIG. 3. The perforation 104 provides a weakened seam or line along which the container seal 100 and, more particularly, polymer layer 202, rips or tears. As the base layer 200 is physically attached to the polymer layer 202, the base layer 200 is also torn or separated and pulled back. As the polymer layer 202 tears along the perforation 104, stresses are placed on the base layer 200 at the edges of the polymer layer 202 along the region of the perforation, thereby causing the base layer 200 to rip or tear or separate with the polymer layer 202. The pull tab 102, including a portion of the base layer 200 and the polymer layer 202, are thereby removed or separated from the container seal 100 to form an opening 306 through which the liquid product 303 may be dispensed. In other words, pulling back the pull tab 102 separates a first portion of the base layer from a second portion of the base layer, thereby forming an opening 306 in the container seal 100 from which the liquid product 303 may be dispensed.

Removing the pull tab 102, which forms an opening 306 that is smaller than the mouth 208 of the container 210, provides an opening 306 through which the liquid product 303 can be dispensed from the container 210 slower and with more control than dispensing the liquid product 303 from the entire mouth 208 of the container 210. The smaller opening 306 may remain as part of the container 210 throughout the lifetime of the liquid product (e.g., until all of the liquid product 303 has been used or discarded). Removing the pull tab 102 removes a first portion (i.e., the pull tab and portion within the perforations 104) of the polymer layer 202 while a second portion or a remainder 106, 308 of the polymer layer 202 remains attached to the container 210. The first portion may have a first area that is less than a second area of the second portion, wherein the second area is greater than the first area. The pull tab (e.g., the first portion) 102 may cover, for example, about 50% or less, or about 25% or less, or about 10% or less, or about 5% or less, of a total area of the mouth 208 of the container 210, while the second portion 106, 308 may cover, for example, about 50% or more, or about 75% or more, or about 90% or more, or about 95% or more, of the total area of the mouth 208 of the container 210.

Figure 4:
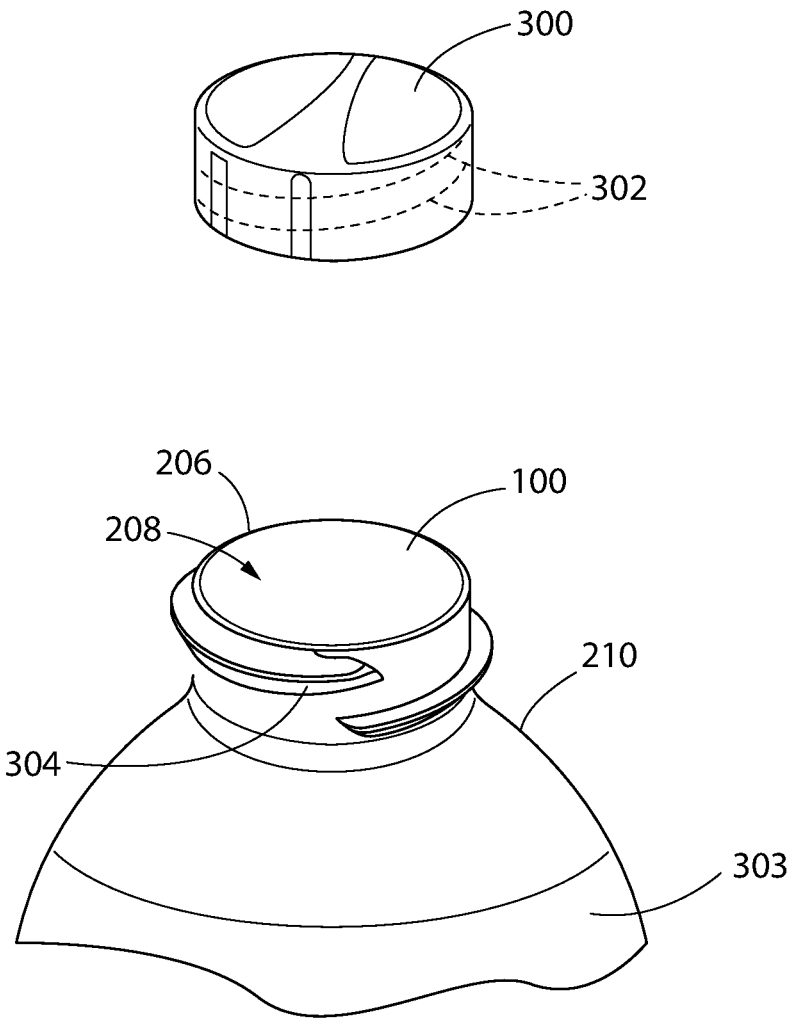
FIG. 4 is a perspective depiction of the FIG. 3 container after completely removing the container seal according to the present teachings.

For users who prefer to dispense the liquid product 303 more quickly from a larger opening, the pull tab 102 may be removed as described above, and then the remainder 308 of the container seal 100 (i.e., the non-tabbed second portion 308 of the container seal 100) may be removed, for example, by inserting a finger into the opening 306 and removing the non-tabbed portion 308 of the container seal 100. This exposes the entire mouth 208 of the container 210 as depicted in FIG. 4, and provides a large opening through which a larger volume of the liquid product 303 can be more quickly dispensed from the container 210.

Figure 5:
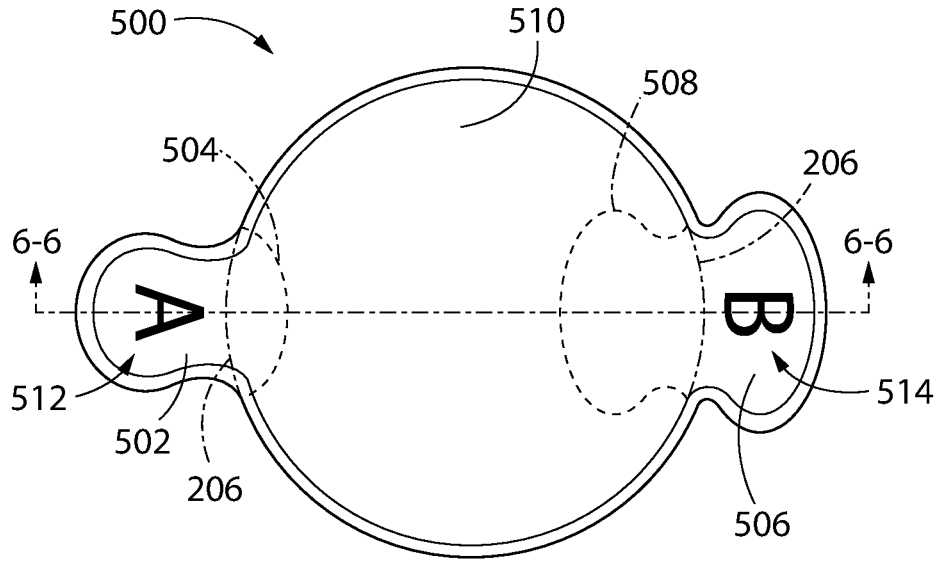
FIG. 5 is a plan view of a container seal having two pull tabs that form two different sized openings according to the present teachings.
Figure 6:
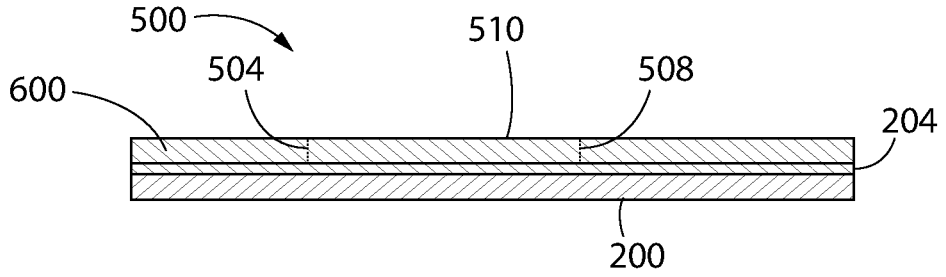
FIG. 6 is a cross section of a container seal having two pull tabs that form two sized openings according to the present teachings.

Various other examples of container seals having various configurations of pull tabs and/or openings are contemplated. For example, FIG. 5 is a plan view, and FIG. 6 is a cross section along 6-6 of the FIG. 5 structure, depicting a container seal 500 that allows for at least three different sizes of container openings. The container seal 500 includes a first pull tab 502 defined in part by a first perforation 504 in or through at least one polymer layer 600 of the container seal 500, and a second pull tab 506 defined in part by a second perforation 508 in or through the at least one polymer layer 600 of the container seal 500. The second pull tab 506 may be positioned longitudinally at an opposite side of the container seal 500 from the first pull tab 502, across a center point of the container seal 500. The container seal 500 further includes a non-tabbed portion 510, a base layer 200, and may include an optional adhesive layer 204 that secures the base layer 200 and the polymer layer 600 together. If used, the adhesive layer 204 may extend across an entire surface of the polymer layer 600 and the base layer 200.

To use the container seal 500, a user may remove either the first pull tab 502 (e.g., with the corresponding, attached first portion of the base layer 200) to expose a first opening to the container or the second pull tab 506 to expose a second, different size opening to the container, where the first opening is smaller than the second opening. The first opening will allow a user to dispense liquid product from the container with more control and at a slower rate than the second opening, while the second opening will allow a user to dispense liquid product from the container at a faster rate but with less control than the first opening. Additionally, after removing the first pull tab 502, the user may remove the second pull tab 506 make two openings available from which to dispense the liquid product 303. Additionally, after removing the first pull tab 502 or the second pull tab 506, or both, a user may remove the entire container seal 500 as described above with reference to FIG. 4 to make the entire mouth of the container available from which to dispense the liquid product 303.

The first pull tab 502 may include one or more first indicium and the second pull tab may include one or more second indicium that is different from the one or more first indicium. The first and second indicia may provide a visual and/or tactile indicator of the size, shape, or other configuration of the opening in the container seal 500 that will be formed by removing the respective pull tab. For example, as depicted in FIG. 5, the first pull tab 502 may have a different shape and/or size than the second pull tab 506. The shape and/or size of each pull tab may correspond to, or otherwise indicate, the shape or size of the opening in the container seal 500 that will be formed by removing the respective pull tab. Further, indicium of the first pull tab 502 may include a first printed or embossed indicium 512 and the second pull tab 506 may include a second printed or embossed indicium 514 different from the first indicium 512.

As depicted in FIG. 5, the first pull tab 502 is configured to remove a first portion of the container seal 500 (the portion defined by perforation 504, including the first tab 502) and the second pull tab 506 is configured to remove a second portion of the container seal 500 (the portion defined by perforation 508, including the second tab 506). The first portion has a first surface area and the second portion has a second surface area that may be different (larger or smaller), or the same as, the first surface area. In FIG. 5, the first surface area and the second surface area are, together, less than the overall surface area of the entire container seal 500, with the remainder being the non-tabbed portion 510. In an embodiment, the first surface area and the second surface area, when added together, may be about 50% or less, or about 25% or less, or about 10% or less, of the entire surface area of the container seal 500.

Figure 7:
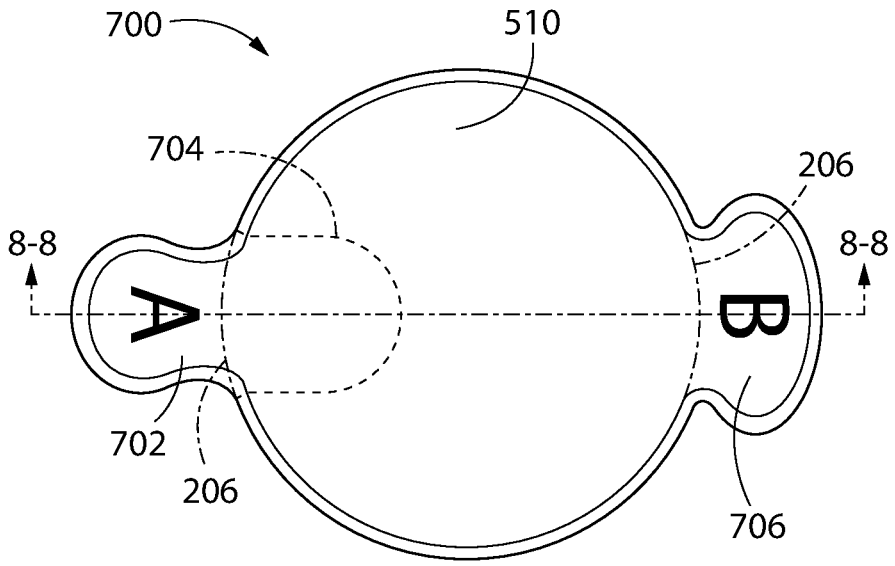
FIG. 7 is a plan view of a container seal having two pull tabs according to the present teachings.
Figure 8:
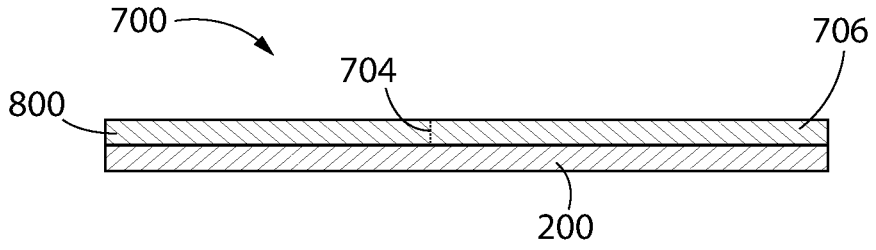
FIG. 8 is a cross section of a container seal having two pull tabs according to the present teachings.

FIG. 7 is a plan view, and FIG. 8 is a cross section along 8-8 of the FIG. 7 structure, depicting a container seal 700 having two pull tabs that allow for two different sizes of container openings. The container seal 700 includes a first pull tab 702 defined in part by a perforation 704 in or through at least one polymer layer 800 of the container seal 700, and an unperforated second pull tab 706. The container seal 700 further includes a base layer 200. The container seal 700 of FIG. 8 depicts the use of the polymer layer 800 as an adhesive layer to adhere to the base layer 200, although the optional use of a separate adhesive layer is contemplated.

To use the container seal 700, a user may remove either the first pull tab 702 to expose a first opening to the container or the second pull tab 706 to expose the entire mouth 208 of the container 210. The first opening will allow a user to dispense liquid product from the container with more control and at a slower rate than the second opening, while the second opening will allow a user to dispense liquid product from the container at a faster rate but with less control than the first opening.

As depicted in FIG. 7, the first pull tab 702 is configured to remove a first portion of the container seal 700 (the portion defined by perforation 704, including the first tab 702) and the second pull tab 706 is configured to remove the entirety of the container seal 700. The first portion has a first surface area and the second portion has a second surface area that may be different (larger or smaller), or the same as, the first surface area. In FIG. 7, the first surface area and the second surface area are, together, equal to (i.e., 100% of) the overall surface area of the entire container seal 700.

The structures described above include openings within a container seal, wherein the openings are formed at the edge of the container seal and the openings have a portion that intersect the rim of the container. In some uses of a container, such as directly dispensing a mouthwash or drinkable liquid product from the container into the mouth without a user's lips directly contacting the rim of the container, it may be preferable to have a small opening that does not intersect the rim of the container such that a steady stream of liquid product may be dispensed, for example, by squeezing the container to decrease an internal volume of the container to expel the liquid product from the container through the opening under pressure.

Figure 9:
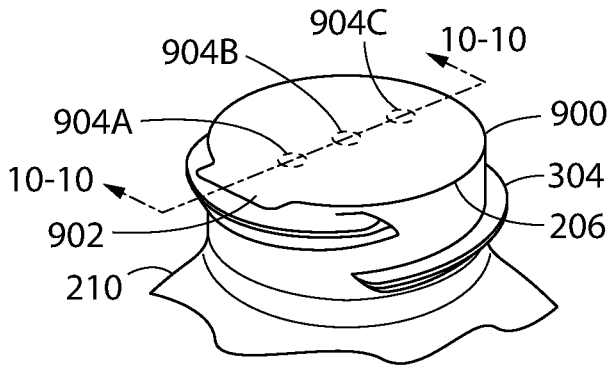
FIG. 9 is a perspective view of a container seal having at least one pull tab according to the present teachings.
Figure 10:
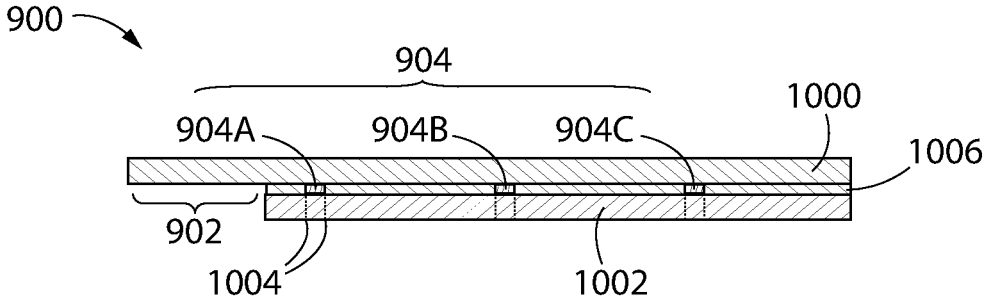
FIG. 10 is a cross section of a container seal having at least one pull tab according to the present teachings.

FIG. 9 is a perspective depiction, and FIG. 10 is a cross section along 10-10 of the FIG. 9 structure, of a container seal 900 having a pull tab 902, wherein the container seal 900 includes a patterned adhesive layer 904 having one or more adhesive portions 904A-904C at one or more locations that function to form an opening or openings that do not intersect the rim 206 of the container 210 and are formed at interior or central location(s) of the container seal 900. Thus, in this example the adhesive layer 904 is not a continuous layer, sheet, or coating.

The container seal 900 may include a polymer layer 1000 and a base layer 1002. As depicted in FIG. 10, the polymer layer 1000 may not be perforated, and the base layer 1002 may include optional perforations 1004 where openings in the base layer 1002 are to be formed. In various examples, as noted above, the perforation 1004 may be a pierced, almost pierced, embossed, indented or otherwise weakened line along which the container seal 900 will tend to tear or separate. The adhesive layer 904 adheres the polymer layer 1000 and the base layer 1002 together. While FIG. 10 depicts adhesive layer 904 with three individual portions 904A-904C at three distinct and individual locations which will provide three openings in the base layer 1002, it will be contemplated that the adhesive layer 904 may be applied to only one location, for example at approximately the center of the mouth of the container (e.g., adhesive 904B), to two locations, or to more than three locations of the container seal 900. The patterned adhesive layer 904 may be applied to either the base layer 1002 or the polymer layer 1000, or both. The adhesive layer 904 may be applied with a dispensing tip such as a spray tip. The adhesive layer 904 may also be patterned using a screen printing process which includes a mask 1006. The mask 1006 may remain as part of the container seal 900 as depicted, or it may be removed after applying the adhesive layer 904. Further, the mask 1006 may be a single-sided adhesive that adheres to either the polymer layer 1000 or to the base layer 1002, while the adhesive layer 904 adheres to both the polymer layer 1000 and the base layer 1002. Additionally, the base layer 1002 may be patterned to be recessed away from the pull tab 902 and may have an edge that is aligned with the outside edge of the rim 206 of the container 210 around the entirety of the rim 206 of the container 210. In such designs, the base layer 1002 does not extend outside of the rim 206, and the part of the pull tab 902 that is grasped by a user does not include a base layer 1002—that part may have only a polymer layer 1000, although other designs are contemplated.

Figure 11:
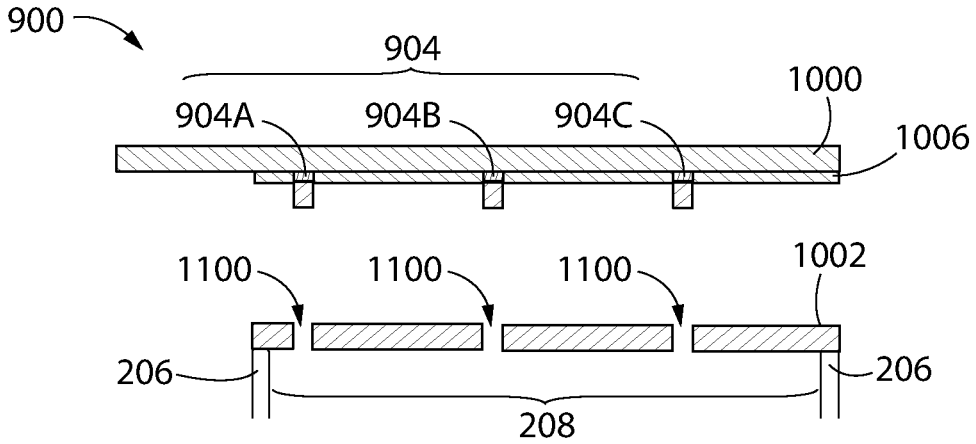
FIG. 11 is a cross section of the FIG. 10 structure after removing the pull tab.

To use the container seal of FIGS. 9 and 10, a user may grasp the pull tab 902 and peel the polymer layer 1000 off of the base layer 1002. As the user peels back the pull tab 902, the adhesive layer 904, which is secured to the polymer layer 1000 and the base layer 1002 at adhesive portions 904A-904C, removes portions of the base layer 1002 to which they are attached to form one or more openings 1100 in the base layer 1002 as depicted in FIG. 11. The one or more openings 1100 are smaller than the mouth 208 of the container 210, and may allow a user to eject liquid product 303 within the container 210 by squeezing the container 210 to decrease the internal volume of the container 210, thereby placing pressure on the liquid product 303 and ejecting the liquid product 303 through the openings 1100 under pressure. If a user prefers to expose the entire mouth 208 of the container 210 to dispense the fluid from the entire mouth 208 of the container 210, the user may remove the container seal 900 from the rim 206, for example by removing the polymer layer 1000, puncturing the second portion of the base layer 1002 that remains with a finger, and then pulling off the base layer 1002. In another example, the container seal 900 may be manufactured to include an additional pull tab to facilitate removal of the entire lid, for example, similar to structure 706 of FIG. 7, wherein the base layer 1002 may extend under the second pull tab 706.

The container seal 900 of FIGS. 9 and 10, in contrast to the container seal 500 of FIG. 5, for example, includes openings 1100 that do not intersect the rim 206 of the container 210 or an outer edge or perimeter of the base layer 1002. Further, the openings are formed within the outer perimeter or edge of the base layer 1002 such that the entire edge of the base layer 1002 remains intact. Although the example of FIGS. 9-11 is shown with three openings 1100, a container seal having a single opening (e.g., a single first portion of the base layer 1002 removed) located at the approximate center of the mouth of the container, or at another location, is contemplated and may be useful for dispensing the liquid product from the container directly into a user's mouth without contacting the container 210 and/or the container seal 900 to the lips.

Figure 12:
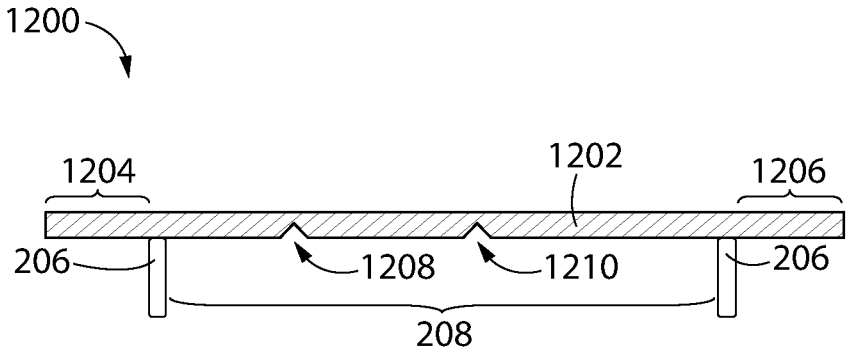
FIG. 12 is a cross section of a container seal having a single layer.

FIG. 12 depicts an embodiment of a container seal 1200 that includes only a single layer, for example, a base layer 1202. The base layer 1202 may be a foil layer, a polymer layer such as a plastic layer, or another suitable layer. The container seal 1200 may include a first pull tab 1204 and a second pull tab 1206. The first pull tab 1204 may be defined by a first perforation 1208 in the container seal 1200, and the second pull tab 1206 may be defined by a second perforation 1210 in the container seal 1200. In various designs, the perforations 1208, 1210 may be a pierced, almost pierced, embossed, indented, notched, or otherwise weakened line or area along which the container seal 1200 will tear or separate or will tend to tear or separate. To provide a relatively smaller opening to the mouth 208 of the container, a user may pull the first pull tab 1204 to tear the container seal 1200 along the first perforation 1208. To provide a relatively larger opening to the mouth of the container, a user may pull the second pull tab 1206 to tear the container seal 1200 along the second perforation 1210. In addition, a user may remove the majority or entirety of the container seal 1200 to expose the entire mouth 208 of the container.

Thus, various embodiments allow a user to configure the container to have a relatively smaller opening for controlled dispensing of a product from the container at a relatively slower rate with relatively more controlled dispensing, or a relatively larger opening for more rapid dispensing of the product from the container at a relatively faster rate. Moreover, while the product is described above with reference to a liquid product, it will be appreciated that the product dispensed may be a solid product such as a powder or a gel product. Further, once an opening is formed in the container seal by removing a portion of the container seal using a pull tab, the pull tab may be discarded such that opening is not resealed by the removed portion. Additionally, while the disclosure above describes one or two pull tabs each forming a different size opening, it will be understood that a container seal may include three or more pull tabs forming three or more different sized openings, the same sized openings, or a combination of different sized openings and same sized openings. The container seal may be a flexible container seal formed from one or more pliable and flexible layers, or the container seal may be formed from one or more rigid layers.

It will be appreciated that the assemblies represented by the FIGS. herein may include other structures, features, and/or layers that have not been depicted for simplicity, and that depicted structures, features, and/or layers may be removed or modified.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A container seal, comprising:

a base layer;

a first pull tab configured to facilitate removal of a first portion of the base layer from the container seal to define a first opening within the container seal, wherein the first portion of the base layer has a first surface area; and a second pull tab configured to facilitate removal of a second portion of the base layer, the second portion having a second surface area, wherein the first surface area is smaller than the second surface area.

2. The container seal of claim 1, wherein the first surface area and the second surface area together comprise 100% of a surface area of an entirety of the container seal.

3. The container seal of claim 1, wherein the first surface area and the second surface area together comprise 50% or less of a surface area of an entirety of the container seal.

4. The container seal of claim 1, further comprising a polymer layer attached to the base layer, wherein the polymer layer comprises the first pull tab and the second pull tab.

5. The container seal of claim 4, further comprising:

a first perforation in the polymer layer that defines at least a portion of the first pull tab; and a second perforation that defines at least a portion of the second pull tab.

6. The container seal of claim 4, further comprising an adhesive layer that attaches the polymer layer and the base layer together.

7. The container seal of claim 4, wherein the first pull tab is further configured to facilitate removal of at least two portions of the base layer to define at least two openings in the second portion of the base layer.

8. The container seal of claim 1, wherein:

the first pull tab comprises a first indicium that provides an indicator of a configuration of the first opening; and the second pull tab comprises a second indicium different from the first indicium that provides an indicator of a configuration of the second opening.

9. The container seal of claim 1, further comprising a non-tabbed third portion of the container seal wherein the first portion of the container seal and the second portion of the container seal are configured to be separated from the third portion of the container seal.

10. A container, comprising:

a rim that defines a mouth of the container; and a container seal attached to the rim, comprising:

a base layer;

a first pull tab configured to facilitate removal of a first portion of the base layer from the container seal to define a first opening within the container seal, wherein the first portion of the base layer has a first surface area; and a second pull tab configured to facilitate removal of a second portion of the base layer, the second portion having a second surface area, wherein the first surface area is smaller than the second surface area.

11. The container of claim 10, wherein the first surface area and the second surface area together comprise 100% of a surface area of an entirety of the container seal.

12. The container of claim 10, wherein the first surface area and the second surface area together comprise 50% or less of a surface area o fan entirety of the container seal.

13. The container of claim 10, further comprising a polymer layer attached to the base layer, wherein the polymer layer comprises the first pull tab and the second pull tab.

14. The container of claim 13, further comprising:

a first perforation in the polymer layer that defines at least a portion of the first pull tab; and a second perforation that defines at least a portion of the second pull tab.

15. The container of claim 13, further comprising an adhesive layer that attaches the polymer layer and the base layer together.

16. The container of claim 13, wherein the first pull tab is further configured to facilitate removal of at least two portions of the base layer to define at least two openings in the second portion of the base layer.

17. The container of claim 10, wherein:

the first pull tab comprises a first indicium that provides an indicator of a configuration of the first opening; and the second pull tab comprises a second indicium different from the first indicium that provides an indicator of a configuration of the second opening.

18. The container of claim 10, further comprising a non-tabbed third portion of the container seal wherein the first portion of the container seal and the second portion of the container seal are configured to be separated from the third portion of the container seal.

19. The container of claim 10, wherein the second pull tab is configured to remove an entirety of the container seal from the rim of the container.

* * * * *